US012290212B1

(12) United States Patent
Lin et al.

(10) Patent No.: US 12,290,212 B1
(45) Date of Patent: May 6, 2025

(54) TOWEL WARMER BUCKET

(71) Applicant: Guangzhou Hansong Electric Technology Co., Limited, Guangdong (CN)

(72) Inventors: Zhenji Lin, Guangdong (CN); Zhilin Fan, Guangdong (CN)

(73) Assignee: Guangzhou Hansong Electric Technology Co., Limited, Guangzhou (CN)

( * ) Notice: Subject to any disclaimer, the term of this patent is extended or adjusted under 35 U.S.C. 154(b) by 0 days.

(21) Appl. No.: 18/822,408

(22) Filed: Sep. 2, 2024

Related U.S. Application Data

(63) Continuation-in-part of application No. 29/950,753, filed on Jul. 4, 2024, now Pat. No. Des. 1,049,330.

(30) Foreign Application Priority Data

Jul. 22, 2024 (CN) ..... 202430458767.3
Aug. 6, 2024 (CN) ..... 202421899400.6

(51) Int. Cl.
*A47K 10/02* (2006.01)

(52) U.S. Cl.
CPC ..... *A47K 10/025* (2013.01)

(58) Field of Classification Search
CPC ..... A47K 10/025
USPC ..... 34/260
See application file for complete search history.

(56) References Cited

U.S. PATENT DOCUMENTS 1,779,182 A * 10/1930 McEwen ..... A47K 10/025 232/1 R
2,334,025 A * 11/1943 O'Neill ..... D06F 58/24 38/143
5,014,446 A * 5/1991 Reesman ..... F26B 9/003 34/239
5,555,640 A * 9/1996 Ou ..... F26B 25/066 312/249.9
6,189,230 B1 * 2/2001 Huen ..... A47K 10/06 34/210
7,171,761 B1 * 2/2007 Hunts ..... D06F 58/10 219/400
8,058,588 B2 * 11/2011 Gagas ..... F24C 15/18 219/400
8,481,895 B2 * 7/2013 Taylor ..... A47K 10/06 219/535
11,602,015 B1 * 3/2023 Peng ..... H02H 1/0007
11,793,366 B2 * 10/2023 Kim ..... F26B 3/06
(Continued)

FOREIGN PATENT DOCUMENTS

EP 4114241 B1 * 8/2024 ..... A47K 10/26
WO WO-2007123560 A1 * 11/2007 ..... A47K 10/06
WO WO-2021176435 A1 * 9/2021 ..... A47K 10/26

*Primary Examiner* — Stephen M Gravini

(57) ABSTRACT

A towel warmer bucket includes: a bucket body assembly and a sound device. The bucket body assembly is configured to heat towels, the bucket body assembly includes: a shell, a heating device, and a PCBA control board, the heating device and the PCBA control board are located inside the shell, and the PCBA control board is provided with a wireless connector thereon. The sound device is installed on the shell, and the heating device and the sound device are electrically connected to the PCBA control board. Placing the towel warmer bucket in the bathroom allows the use of the sound device to play music within the bathroom.

20 Claims, 9 Drawing Sheets

(56) References Cited

U.S. PATENT DOCUMENTS 12,016,499 B2 * 6/2024 Somekh ..... A47K 10/3606
D1,049,330 S * 10/2024 Lin ..... D23/314

* cited by examiner

TOWEL WARMER BUCKET

CROSS-REFERENCE TO RELATED APPLICATIONS

This application is a Continuation-In-Part Application of U.S. Design patent application Ser. No. 29/950,753, filed on Jul. 4, 2024, claims priorities to Chinese Design patent application No. 202430458767.3, filed on Jul. 22, 2024, and Chinese Patent Application No. 202421899400.6, filed on Aug. 6, 2024, which are herein incorporated by reference in their entirety.

TECHNICAL FIELD

The disclosure relates to the field of towel warmer buckets, particularly to a towel warmer bucket.

BACKGROUND

Some users have a preference to play music while bathing or using the toilet in the bathroom, but they generally rely on the speaker of their mobile phone to play the music, which can result in low volume issues. Existing towel warmer buckets are typically placed in bathrooms for use, but they only serve the function of heating or drying towels. Moreover, their large size can occupy valuable bathroom space, and their functionality is relatively singular, not being able to play music.

SUMMARY

In view of this, the disclosure provides a towel warmer bucket to address the issue in the related art where the towel warmer buckets cannot play music.

To achieve one, some, or all of the aforementioned objectives or other objectives, the disclosure proposes the following technical solution.

A towel warmer bucket includes a bucket body assembly and a sound device, the bucket body assembly is configured to heat towels, the bucket body assembly includes a shell, a heating device, and a printed circuit board assembly (PCBA) control board, and the heating device and the PCBA control board are located inside the shell. The PCBA control board is provided with a wireless connector thereon. The sound device is installed on the shell, and the heating device and the sound device are electrically connected to the PCBA control board.

Implementing embodiments of the disclosure has the following beneficial effects:

After adopting the above towel warmer bucket, placing it in the bathroom allows the use of the sound device to play music within the bathroom.

BRIEF DESCRIPTION OF THE DRAWINGS

To more clearly illustrate the technical solutions in the embodiments of the disclosure or in the related art, the following is a brief introduction to the drawings that will be used in the description of the embodiments or the related art. It should be apparent that the drawings described below represent only some of the embodiments of the disclosure, and those skilled in the art can obtain other drawings based on these drawings without creative effort.

DESCRIPTION OF REFERENCE NUMERALS

Figure 1:
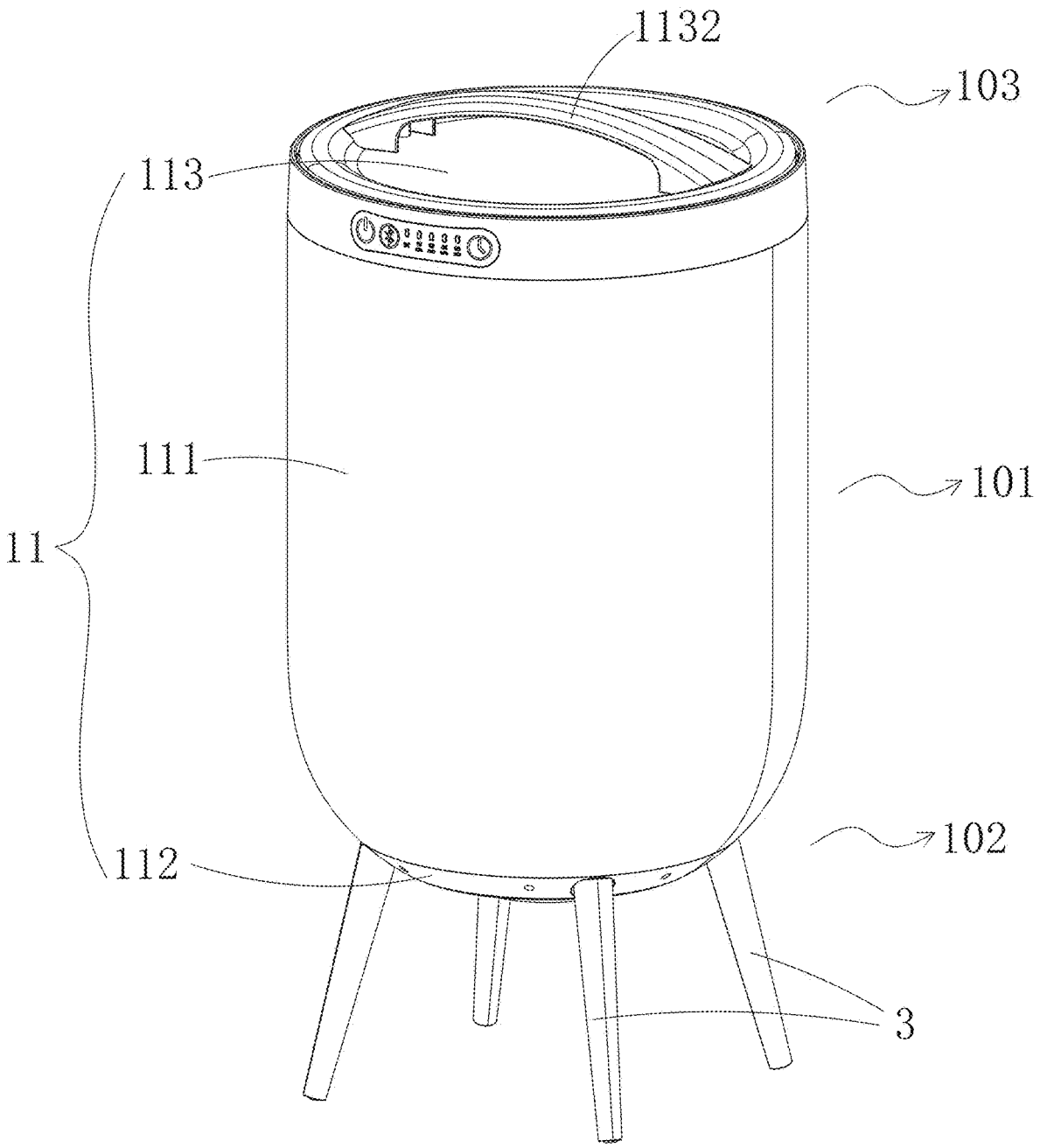
FIG. 1 illustrates a first schematic structural diagram of a towel warmer bucket according to an embodiment of the disclosure.

1—bucket body assembly, 11—shell, 12—heating device, 13—PCBA control board, 101—side wall of the shell, 102—bottom of the shell, 103—top of the shell, 111—bucket body, 112—base, 113—top cover, 121—cylindrical heating plate, 131—wireless connector, 1111—positioning plug, 1112—heating chamber, 1113—snap slot, 1114—shell cylinder, 1115—top fixing ring, 1116—bottom fixing plate, 1121—installation groove, 1122—sound transmission hole, 1123—installation post, 1124—positioning slot, 1125—threaded post, 1126—accommodating groove, 1127—installation boss, 1131—retaining tab, 1132—pull-tab, 11101—bottom of the bucket body, 11102—top of the bucket body, 11121—opening, 11131—slot opening, 11132—entry, 11133—stop block, 11201—side of the base facing towards the bucket body, 11211—bottom of the installation groove, 11261—vertical wall;

2—sound device;

3—support leg, 31—top of the support leg, 311—threaded hole;

4—lighting device, 41—light-emitting surface;

5—translucent cover, 51—bottom surface of the translucent cover, 52—side of the translucent cover close to the installation boss, 53—side of the translucent cover facing away from the installation boss.

DETAILED DESCRIPTION

Unless otherwise defined, all technical and scientific terms used herein shall have the same meanings as commonly understood by those skilled in the art to which the disclosure pertains. The terms used in the specification of the disclosure are for the purpose of describing specific embodiments and are not intended to limit the disclosure. The terms "comprise," "have," and their variations, as used in the specification, claims, and the drawings, are intended to cover non-exclusive inclusions. The terms "first," "second," etc., in the specification, claims, or the drawings are used to distinguish different objects and not to describe any specific order.

In this document, the mention of "embodiment" means that the specific features, structures, or characteristics described in connection with the embodiment can be included in at least one embodiment of the disclosure. The appearance of the phrase at various places in the specification does not necessarily refer to the same embodiment, nor is it exclusive of other embodiments when considered in combination. It is explicitly and implicitly understood by those skilled in the art that the embodiments described herein can be combined with other embodiments.

In order to make those skilled in the art better understand the scheme of the disclosure, the technical scheme in the embodiment of the disclosure will be described clearly and completely with the attached drawings.

Referring to FIGS. 1 to 9, the disclosure provides a towel warmer bucket, which includes a bucket body assembly 1 and a sound device 2.

The bucket body assembly 1 is configured to heat towels, and includes a shell 11, a heating device 12 and a PCBA control board 13.

The shell 11 includes a bucket body 111, a base 112 and a top cover 113. A heating chamber 1112 is defined inside the bucket body 111, and an opening 11121 is defined at the top of the heating chamber 1112. The top cover 113 is detachably installed on the top 11102 of the bucket body 111, and the top cover 113 can cover the opening 11121 at the top of the heating chamber 1112. The base 112 is installed at the bottom 11101 of the bucket body 111.

The sound device 2 can be installed on the bottom 102, top 103, or side wall 101 of the shell 11, specifically, the sound device 2 can be installed on the bucket body 111, the base 112, or the top cover 113. The sound device 2 at least includes a speaker and can be a complete speaker product or a speaker controlled by the PCBA control board 13.

The heating device 12 is installed inside the bucket body 111 and is configured to heat the heating chamber 1112. The heating device 12 includes a cylindrical heating plate 121, which encloses the heating chamber 1112. There is a certain gap between the cylindrical heating plate 121 and the inner wall of the bucket body 111 to prevent users from being burned when they touch the bucket body 111. A PCBA board is installed on the base 112. The PCBA control board 13 is installed on the bottom of the bucket body 111 or on the base 112, and the PCBA control board 13 is provided with a wireless connector 131 thereon. Both the heating device 12 and the sound device 2 are electrically connected to the PCBA control board 13. Users can connect wirelessly, such as via Bluetooth or Wi-Fi, to match and connect their mobile devices with the PCBA control board 13, allowing them to control the heating device 12 and the sound device 2 through their mobile devices. The wireless connector 131 may include a Bluetooth circuit or a Wi-Fi circuit.

Figure 2:
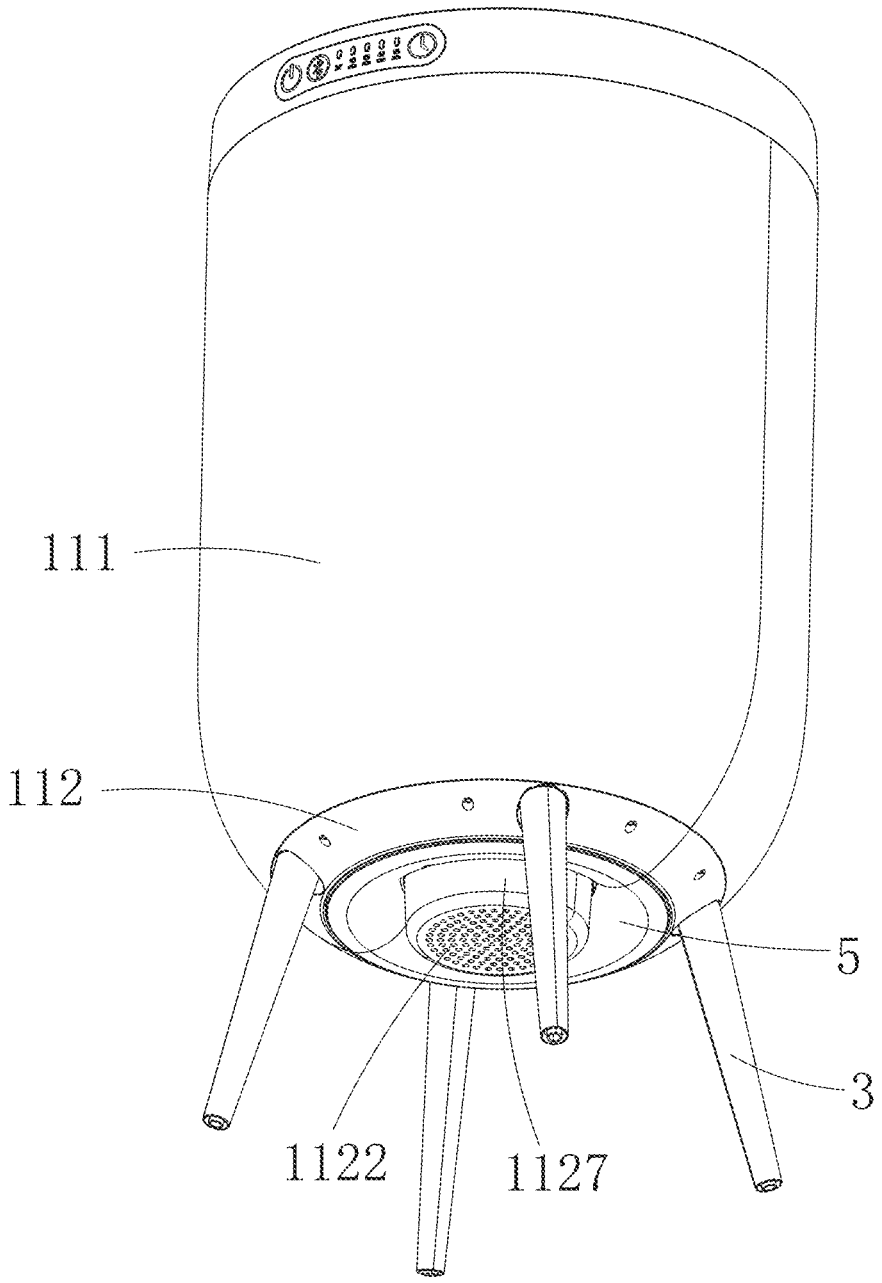
FIG. 2 illustrates a second schematic structural diagram of the towel warmer bucket according to the embodiment of the disclosure.
Figure 3:
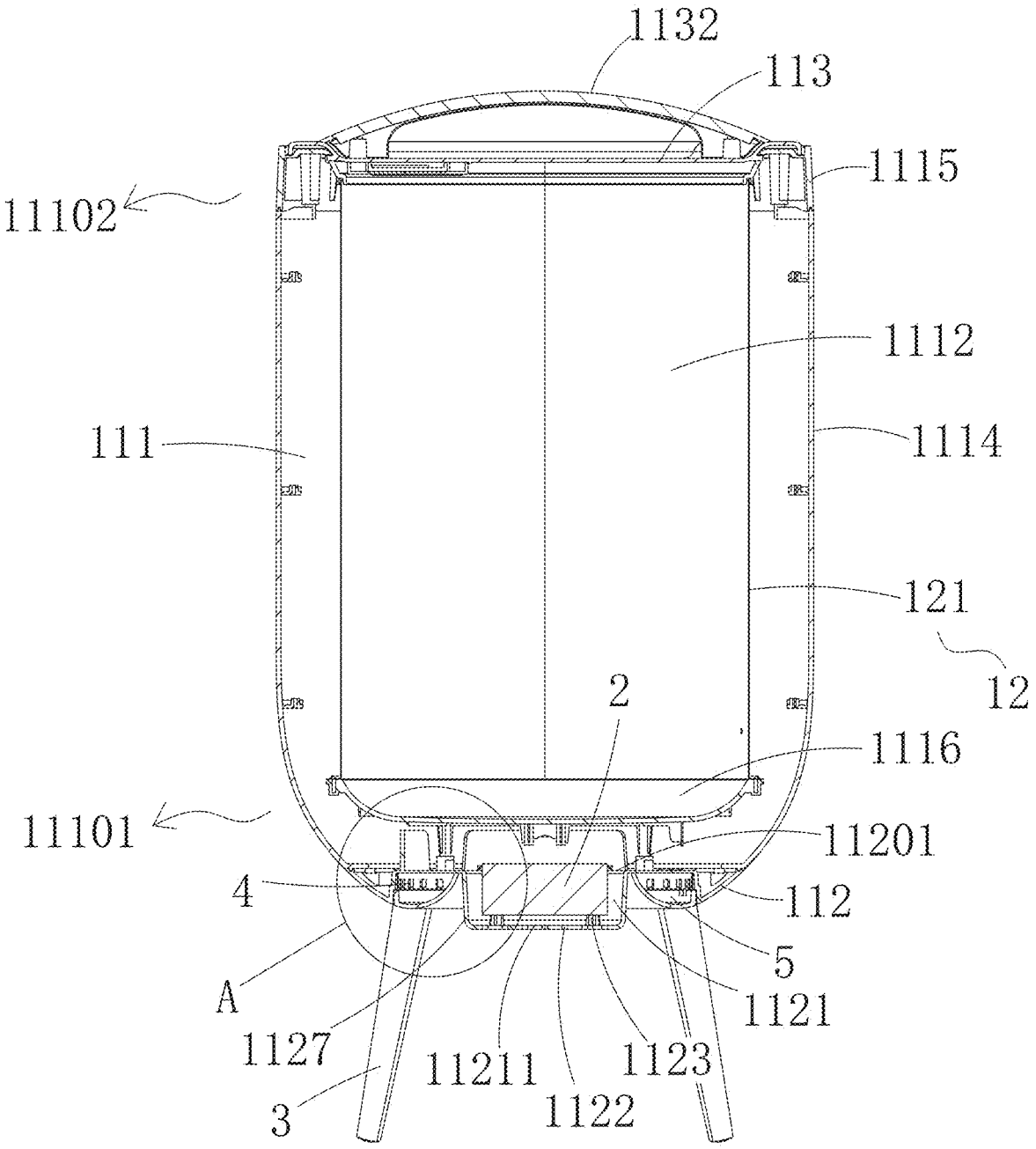
FIG. 3 illustrates a schematic sectional view of the towel warmer bucket according to the embodiment of the disclosure.
Figure 4:
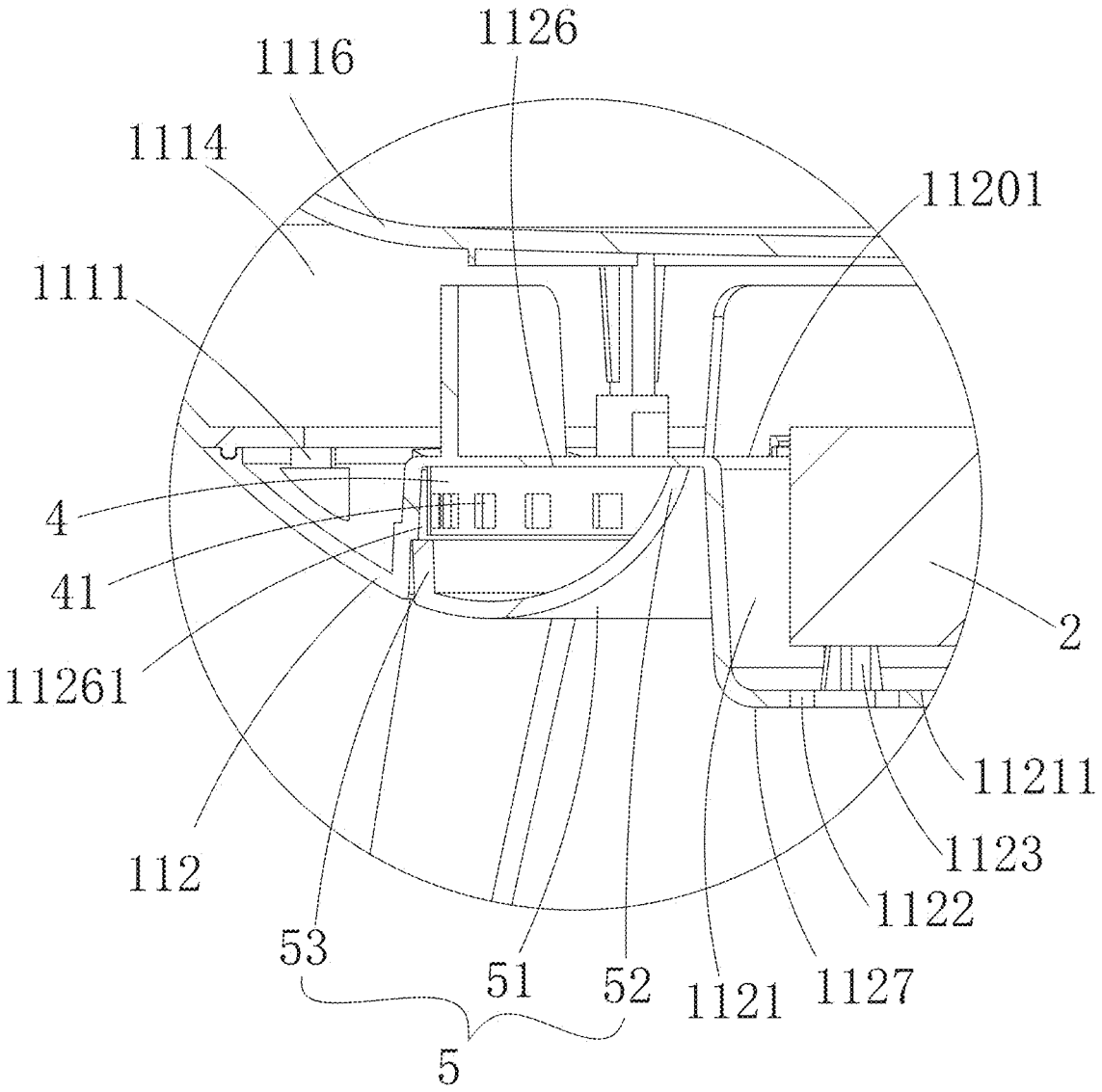
FIG. 4 illustrates an enlarged view of a portion A illustrated in FIG. 3.

Referring to FIGS. 2, 3, and 4, in one embodiment, the sound device 2 is installed on the base 112. Specifically, an installation groove 1121 is defined on the side 11201 of the base 112 facing towards the bucket body 111 and the sound device 2 is located in the installation groove 1121. Sound transmission holes 1122 are defined at the bottom 11211 of the installation groove 1121, connecting the installation groove 1121 to the outside. Additionally, installation posts 1123 are provided on the bottom 11211 of the installation groove 1121. The sound device 2 is bolted on the installation posts 1123, which separates the sound device 2 from the bottom 11211 of the installation groove 1121 (i.e., makes the sound device 2 be spaced apart from the bottom 11211 of the installation groove 1121), allowing the sound produced by the sound device 2 to be transmitted more smoothly to the outside.

Figure 5:
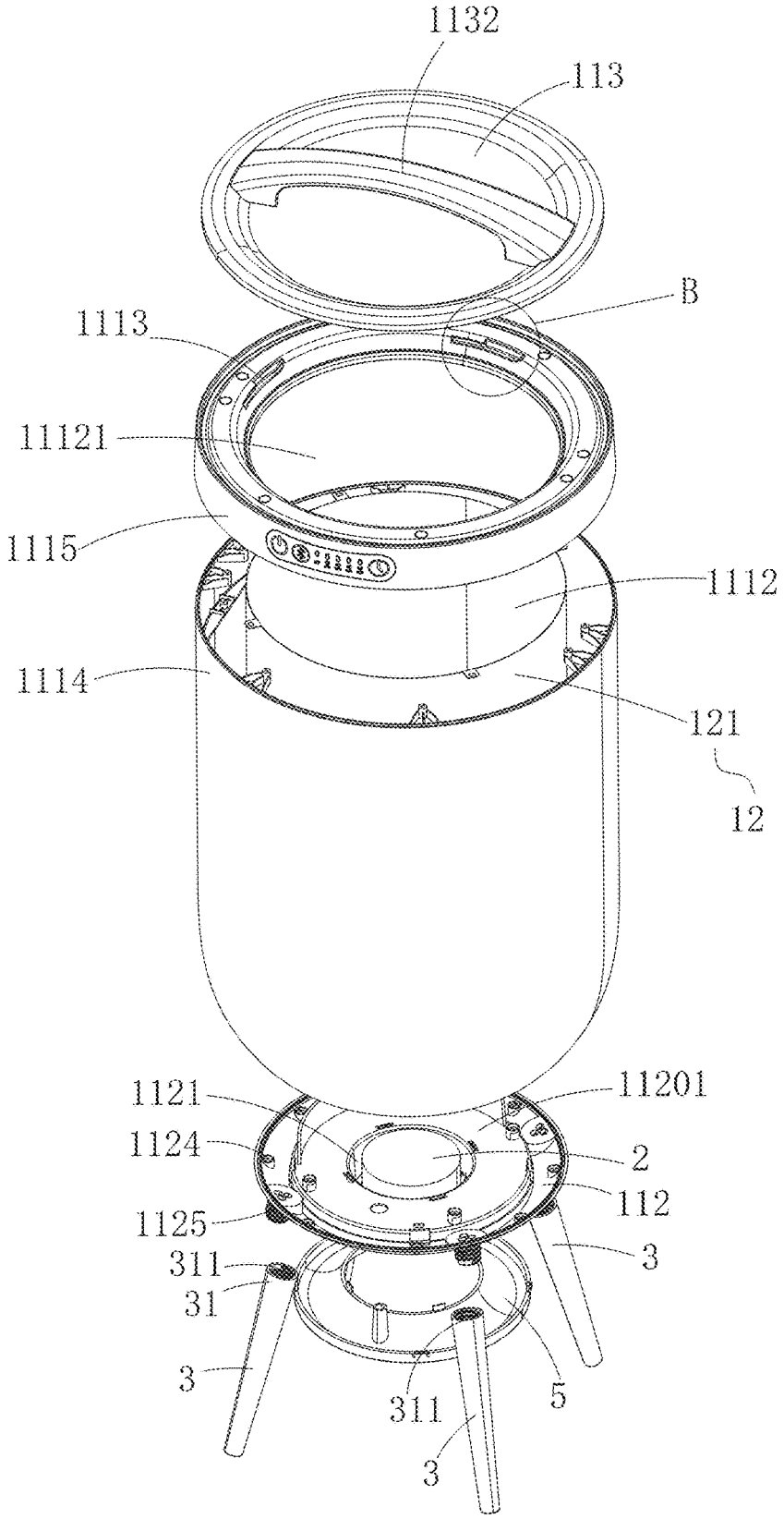
FIG. 5 illustrates a schematic explosive view of the towel warmer bucket according to the embodiment of the disclosure.

As shown in FIGS. 4 and 5, in the embodiment, the bucket body 111 is bolted to the base 112, making the base 112 detachable. A cross-sectional area of the installation groove 1121 is larger than that of the sound device 2, which facilitates replacement or maintenance of the sound device 2 by users. Specifically, multiple positioning plugs 1111 are provided on the bottom of the bucket body 111, and multiple positioning slots 1124 are defined on the base 112, allowing the multiple positioning plugs 1111 to be inserted into the corresponding positioning slots 1124, thus positioning and connecting the base 112 and the bucket body 111. The bolts are used to penetrate the base 112 and threadedly connect to the positioning plugs 1111, thereby fixing the base 112 to the bucket body 111.

Figure 7:
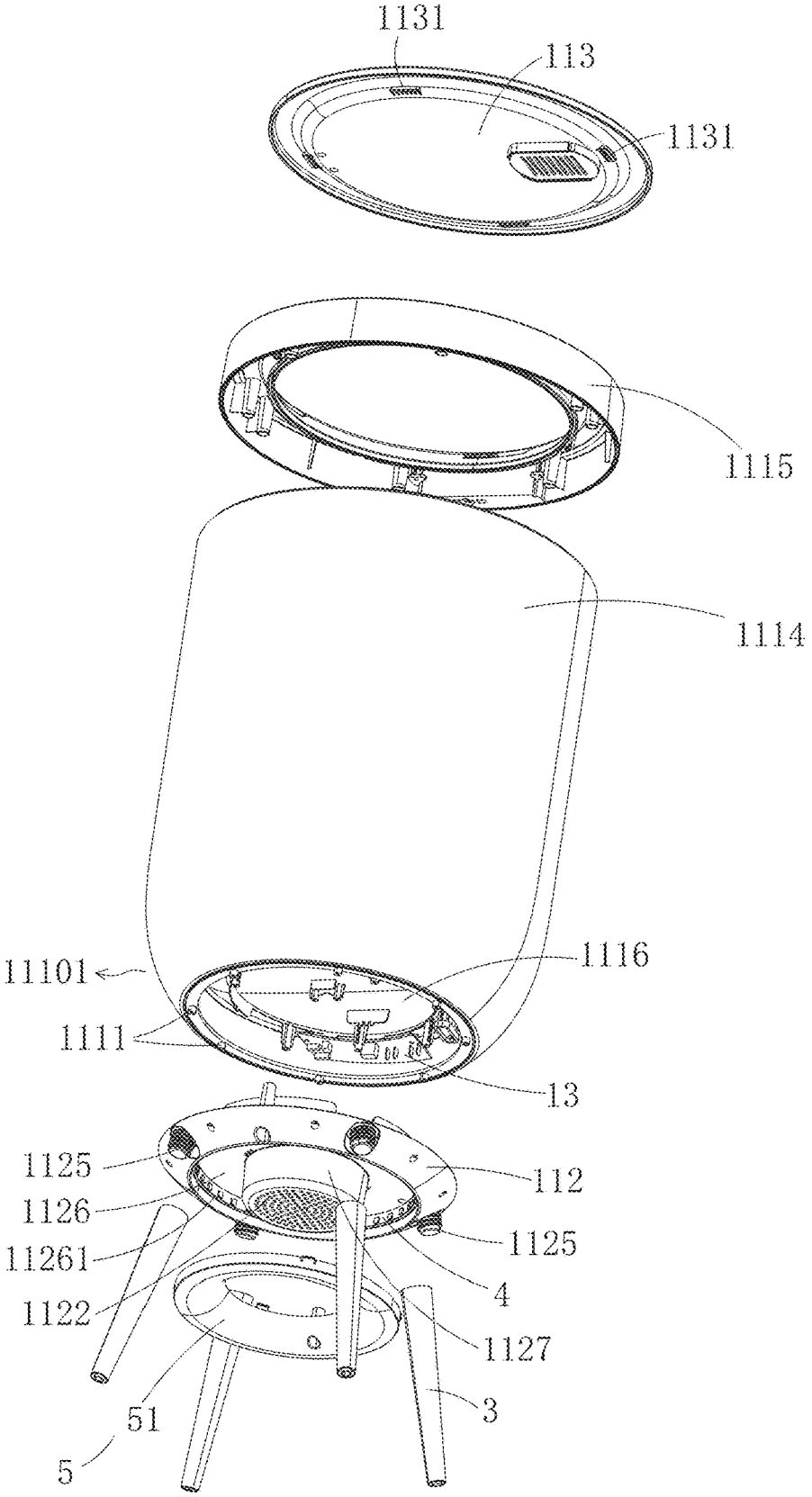
FIG. 7 illustrates another schematic explosive view of the towel warmer bucket according to the embodiment of the disclosure.

Referring to FIGS. 5 and 7, in the embodiment, the towel warmer bucket further includes at least three support legs 3, preferably four support legs 3. The length of the support legs 3 is preferably in the range of 5 centimeters (cm) to 30 cm, for example, the length of the support legs 3 could be 15 cm or 20 cm. All four support legs 3 are installed on the base 112, and they are used to contact the ground, making the base be spaced apart from ground, i.e., lifting the base 112 off the ground. This elevates the base 112, ensuring that the sound transmission holes 1122 are a certain height above the ground, providing sufficient distance for the sound to travel from the sound transmission holes 1122, preventing the ground from obstructing the sound transmission.

Certainly, since the support legs 3 need to be of considerable length, they occupy a significant amount of space. To facilitate the transportation and storage of the towel warmer bucket, the support legs 3 in the embodiment are detachably connected to the base 112. Specifically, four threaded posts 1125 are provided on the outer wall of the base 112, and the tops 31 of the support legs 3 respectively define threaded holes 311. Each of the four support legs 3 is threadedly connected to corresponding one of the four threaded posts 1125. Therefore, when installing the towel warmer bucket, the user can screw the support legs 3 onto the base 112 or remove them by unscrewing them.

In addition, to facilitate the production and mold-making of the base 112, the threaded posts 1125 are produced separately from the base 112 and are secured to the base 112 by bolts, as shown in FIG. 5.

Furthermore, referring to FIGS. 4 and 7, the towel warmer bucket further includes a lighting device 4, which is installed on the bucket body 1. Specifically, the lighting device 4 is arranged around the sound device 2 and disposed on the base 112. The lighting device 4 is a flexible light-emitting diode (LED) light strip. The towel warmer bucket further includes a translucent cover 5, which is snap-fitted onto the outer bottom of the base 112. The translucent cover 5 can then be further secured to the base 112 using bolts. The translucent cover 5 is configured in a ring shape and covers the lighting device 4. The translucent cover 5 is made of a transparent material, such as acrylic. The main function of the translucent cover 5 is to protect the light strip from the effects of a humid environment. The lighting device 4 serves two purposes: it provides illumination and can also change the brightness of its light in sync with the music, enhancing the visual appeal for the user.

In the embodiment, the bottom of the base 112 defines an accommodating groove 1126, and in the center of the accommodating groove 1126, there is an installation boss 1127 that extends downward. The installation groove 1121 extends from top to bottom into the installation boss 1127, and the sound transmission holes 1122 penetrate the installation boss 1127. As a result, the accommodating groove 1126 is roughly ring-shaped.

The flexible LED light strip is arranged around the installation boss 1127 and attached to the inner wall of the accommodating groove 1126, specifically, it is attached to the vertical wall 11261 of the accommodating groove 1126, which is the wall facing away from the installation boss 1127.

The light-emitting surface 41 of the flexible LED light strip faces towards the installation boss 1127, and the translucent cover 5 covers the accommodating groove 1126. The bottom surface 51 of the translucent cover 5 is arc-shaped, and the side 52 of the translucent cover 5 close to the installation boss 1127 is higher than the side 53 of the translucent cover 5 facing away from the installation boss 1127, as shown in FIG. 4.

Specifically, the surface of the translucent cover 5 can be frosted. After the light from the flexible LED light strip is scattered by the translucent cover 5, it illuminates a wider area, resulting in a more noticeable visual effect.

Figure 8:
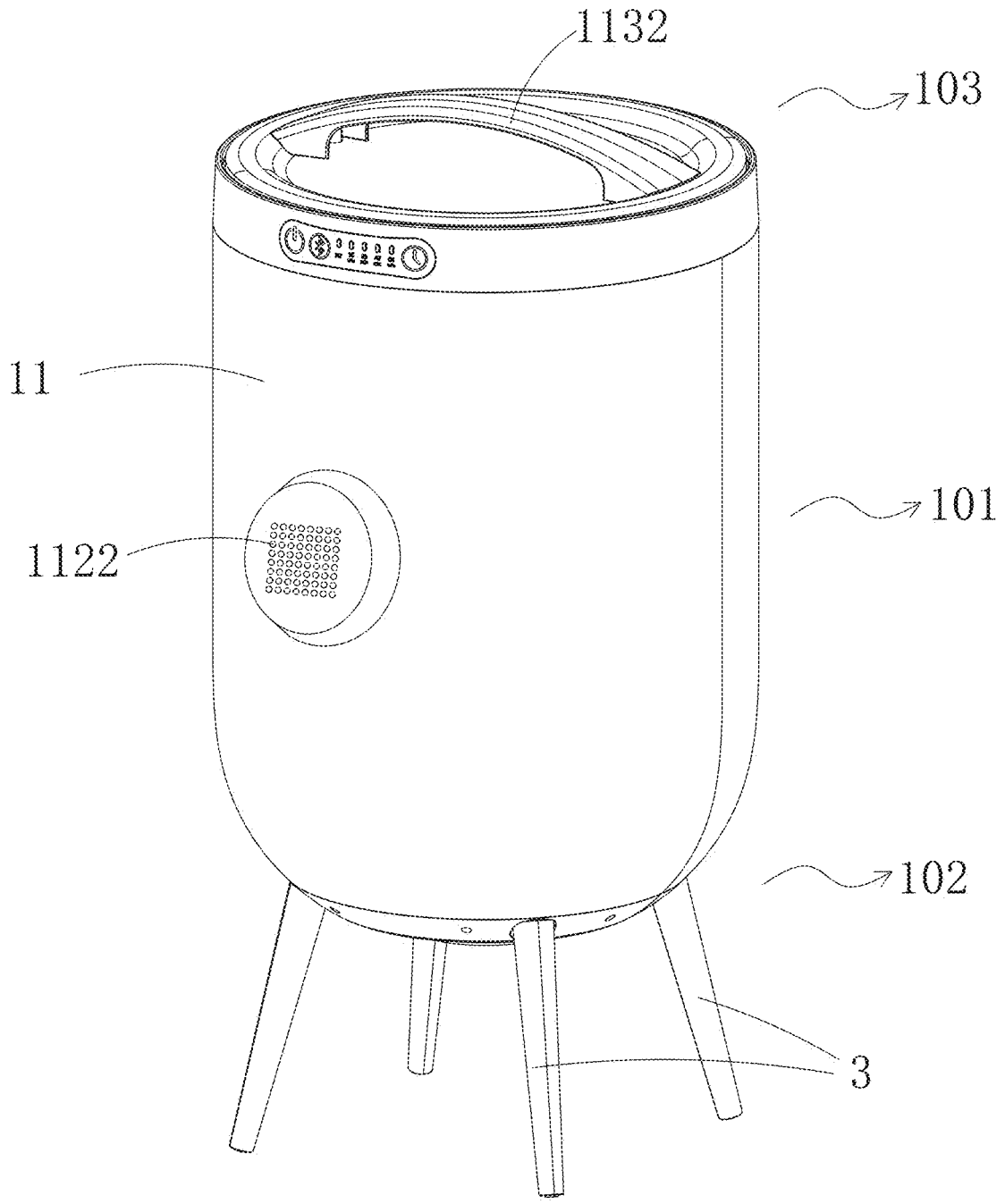
FIG. 8 illustrates a schematic structural diagram of a towel warmer bucket according to another embodiment of the disclosure.

Referring to FIG. 8, in another embodiment, the sound device 2 is installed on the side wall 101 of the bucket body 1. Specifically, the sound device 2 is installed on the outer wall or inner wall of the bucket body 111, and the aforementioned sound transmission holes 1122 are defined on the bucket body 111. In this embodiment, extended support legs 3 can be set, or no support legs 3 may be needed, as the sound produced by the sound device 2 is minimally affected by the ground.

Figure 9:
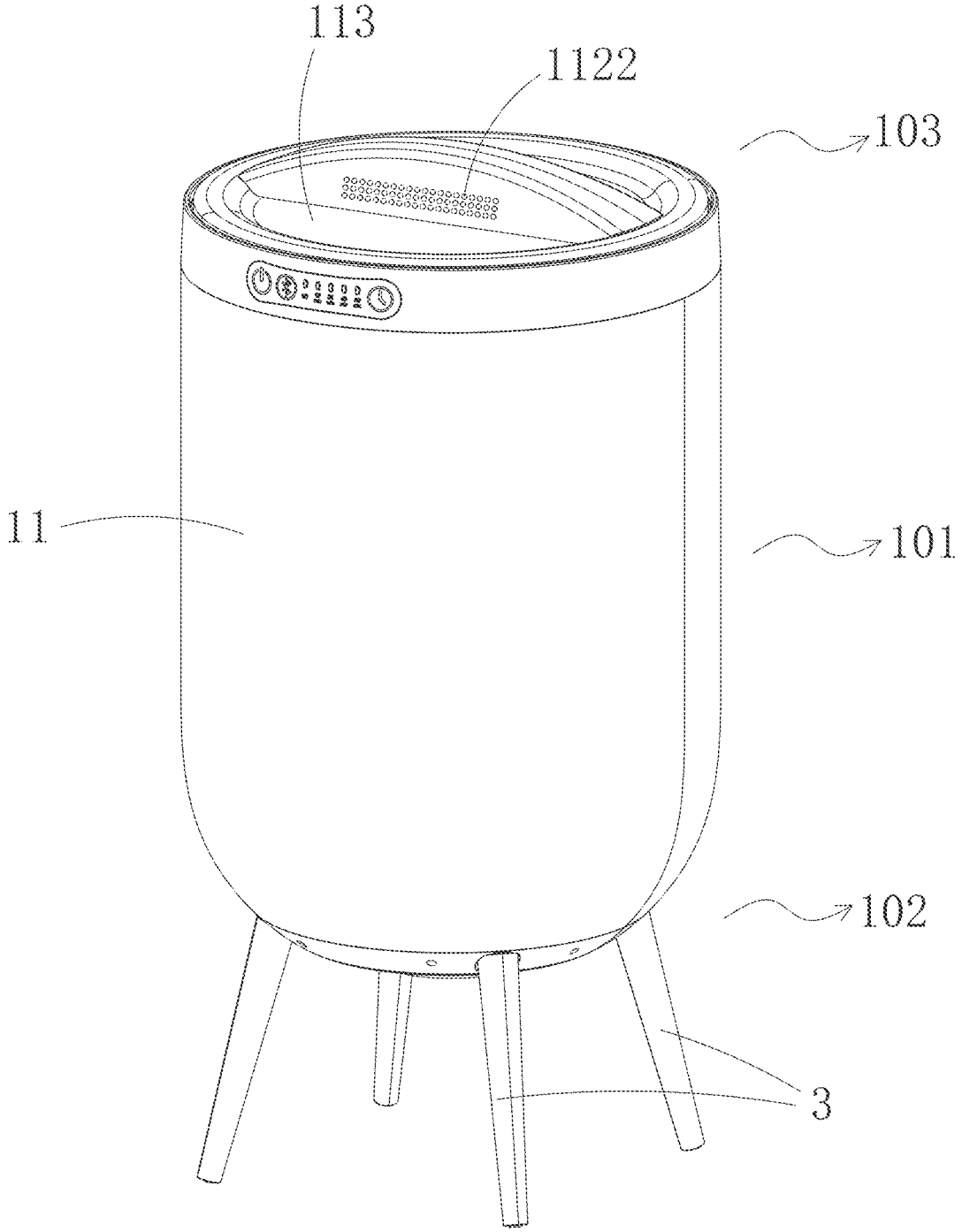
FIG. 9 illustrates a schematic structural diagram of a towel warmer bucket according to still another embodiment of the disclosure.

Referring to FIG. 9, in still another embodiment, the sound device 2 is installed on the top 103 of the bucket body 1. Specifically, the sound device 2 is installed inside the top cover 113, which is hinged to the bucket body 111, and the aforementioned sound transmission holes 1122 are defined on the top cover 113.

Figure 6:
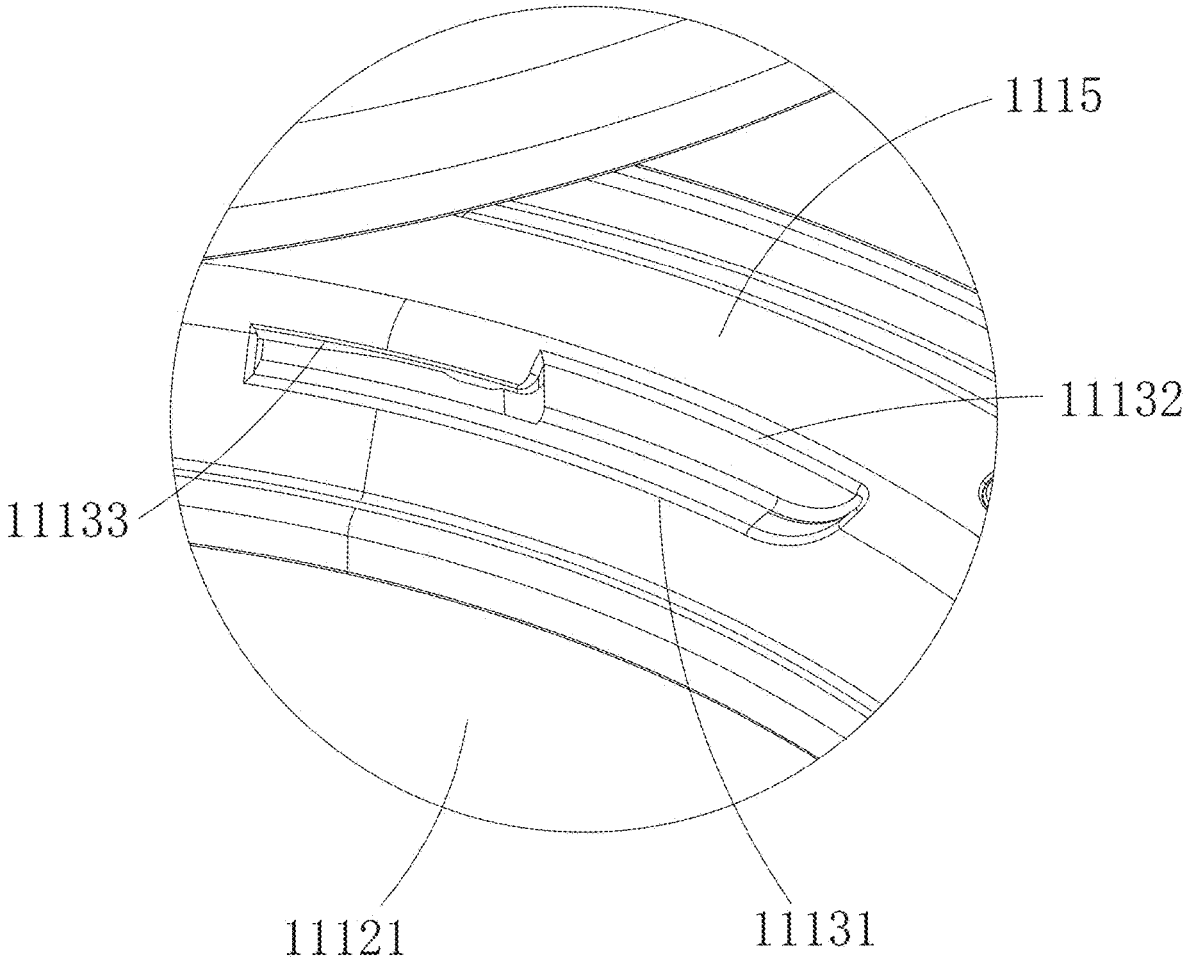
FIG. 6 illustrates an enlarged view of a portion B illustrated in FIG. 5.

Referring to FIGS. 5, 6, and 7, in at least one embodiment, the bucket body 111 defines at least two snap slots 1113, for example, four snap slots 1113. The snap slots 1113 extend circumferentially around the opening 11121, with the slot openings 11131 facing toward the inside of the opening 11121. The top of each snap slot 1113 is provided with an entry 11132 connected to the slot opening 11131, and a stop block 11133 is provided next to the entry 11132. At least two horizontally extending retaining tabs 1131 are provided on the top cover 113, that is, four retaining tabs 1131 are provided to respectively correspond to the four snap slots 1113. The four retaining tabs 1131 can be respectively inserted into the snap slots 1113 through the entries 11132, passing through the slot openings 11131. The retaining tabs 1131 can slide along the snap slots 1113 until they reach under the stop blocks 11133, where they can abut against the stop blocks 11133. Increasing the number of retaining tabs 1131 and snap slots 1113 enhances the stability of the connection between the bucket body 111 and the top cover 113.

When the retaining tabs 1131 slide into the snap slots 1113 and are positioned below the stop blocks 11133, the bucket body 111 is fixedly connected with the top cover 113. A pull-tab 1132 can be disposed on the top cover 113. When the user pulls the pull-tab 1132, the entire towel warmer bucket can be lifted, making it convenient to move the towel warmer bucket to a different location.

In this embodiment, the bucket body 111 includes a shell cylinder 1114, a top fixing ring 1115, and a bottom fixing plate 1116. The top fixing ring 1115 is bolted to the top of the shell cylinder 1114, and the bottom fixing plate 1116 is located inside the shell cylinder 1114.

The cylindrical heating plate 121 has its top embedded in the top fixing ring 1115 and its bottom embedded in the bottom fixing plate 1116, and the bottom fixing plate 1116 is connected to the base 112. The PCBA control board 13 is located below the bottom fixing plate 1116.

The heating chamber 1112 is formed by the cylindrical heating plate 121 and the bottom fixing plate 1116. The opening 11121 is located at the center of the top fixing ring 1115, and the snap slots 1113 are disposed on the top fixing ring 1115. This configuration is primarily designed to facilitate the disassembly and assembly work between the bucket body 111 and the heating device 12.

Apparently, the embodiments described above are merely part of the embodiments of the disclosure, and not all of them. The drawings show preferred embodiments of the disclosure, but they do not limit the scope of the disclosure. The disclosure can be implemented in many different forms. Instead, the purpose of providing these embodiments is to make the understanding of the disclosure of the disclosure more thorough and comprehensive. Despite the detailed description of the disclosure with reference to the foregoing embodiments, those skilled in the art can still modify the technical solutions recorded in the specific embodiments or substitute some of the technical features with equivalents. Any equivalent structure derived from the disclosure's specification and drawings, directly or indirectly applied in other related technical fields, is likewise within the scope of protection of the disclosure.

We claim:

1. A towel warmer bucket, comprising:

a bucket body assembly, configured to heat towels, wherein the bucket body assembly comprises: a shell, a heating device, and a printed circuit board assembly (PCBA) control board, the heating device and the PCBA control board are located inside the shell, and the PCBA control board is provided with a wireless connector thereon; and a sound device, installed on the shell, wherein the heating device and the sound device are electrically connected to the PCBA control board; the sound device comprises a speaker configured to output sound to an exterior of the towel warmer bucket.

2. The towel warmer bucket according to claim 1, wherein the sound device is installed at a bottom of the shell.

3. The towel warmer bucket according to claim 2, wherein the shell comprises: a bucket body and a base, the base is installed at a bottom of the bucket body, and the sound device is installed inside the base.

4. A towel warmer bucket, comprising:

a bucket body assembly, configured to heat towels, wherein the bucket body assembly comprises: a shell, a heating device, and a printed circuit board assembly (PCBA) control board, the heating device and the PCBA control board are located inside the shell, and the PCBA control board is provided with a wireless connector thereon; and a sound device, installed on the shell, wherein the heating device and the sound device are electrically connected to the PCBA control board; the sound device is configured to output sound to an exterior of the towel warmer bucket;

wherein the shell comprises: a bucket body and a base, the base is installed at a bottom of the bucket body, the sound device is installed inside the base;

a side of the base facing towards the bucket body defines an installation groove, the sound device is installed in the installation groove, and a bottom of the installation groove defines at least one sound transmission hole; the at least one sound transmission hole is configured to enable the sound output from the sound device to be transmitted to the exterior of the towel warmer bucket.

5. The towel warmer bucket according to claim 4, wherein the bottom of the installation groove is provided with at least one installation post, and the sound device is bolted on the at least one installation post to make the sound device be spaced apart from the bottom of the installation groove.

6. The towel warmer bucket according to claim 3, wherein the bucket body is bolted to the base.

7. The towel warmer bucket according to claim 3, further comprising: at least three support legs, and the at least three support legs being installed on the base to make the base be spaced apart from ground.

8. The towel warmer bucket according to claim 7, wherein the at least three support legs are detachably connected to the base.

9. The towel warmer bucket according to claim 8, wherein the base is provided with at least three threaded posts, tops of the at least three support legs are respectively provided with threaded holes, and the at least three support legs are threadedly connected to the at least three threaded posts, respectively.

10. The towel warmer bucket according to claim 9, wherein the at least three threaded posts are located on an outer side of the base, and the at least three threaded posts are bolted to the base.

11. The towel warmer bucket according to claim 4, further comprising: a lighting device, and the lighting device being installed on the shell.

12. The towel warmer bucket according to claim 11, wherein the lighting device is arranged around the sound device.

13. The towel warmer bucket according to claim 12, further comprising: a translucent cover, the translucent cover being snap-fitted onto the base, and the translucent cover being of annular structure and covering the lighting device.

14. The towel warmer bucket according to claim 13, wherein a bottom of the base defines an accommodating groove, a center of the accommodating groove is provided with a downwardly extending installation boss, the installation groove extends into the installation boss, and the plurality of sound transmission holes penetrate the installation boss;

the lighting device is arranged around the installation boss and attached to an inner wall of the accommodating groove, a light-emitting surface of the lighting device faces towards the installation boss; and the translucent cover covers the accommodating groove.

15. The towel warmer bucket according to claim 14, wherein a bottom surface of the translucent cover is arc-shaped, and a side of the translucent cover close to the installation boss is higher than a side of the translucent cover facing away from the installation boss.

16. The towel warmer bucket according to claim 1, wherein the sound device is installed on a side wall of the shell.

17. The towel warmer bucket according to claim 1, wherein the sound device is installed on a top of the shell.

18. The towel warmer bucket according to claim 17, wherein the shell comprises: a bucket body and a top cover, the top cover is installed on a top of the bucket body, and the sound device is installed inside the top cover.

19. The towel warmer bucket according to claim 1, wherein the shell comprises: a bucket body and a top cover, the bucket body defines a heating chamber, a top of the heating chamber is provided with an opening, the bucket body defines at least two snap slots, the at least two snap slots extend circumferentially around the opening, slot openings of the at least two snap slots face towards an inside of the opening, tops of the at least two snap slots are respectively provided with entries communicating with the slot openings, and stop blocks are respectively provided next to the entries; and the top cover is provided with at least two horizontally extending retaining tabs, the at least two retaining tabs are insertable into the at least two snap slots from the entries to pass through the slot openings; the at least two retaining tabs are capable of sliding along the at least two snap slots to below the stop blocks to be in contact with the stop blocks.

20. The towel warmer bucket according to claim 19, wherein the bucket body comprises: a shell cylinder, a top fixing ring, and a bottom fixing plate, the top fixing ring is bolted to a top of the shell cylinder, and the bottom fixing plate is located inside the shell cylinder; and the heating device comprises: a cylindrical heating plate, a top of the cylindrical heating plate is embedded in the top fixing ring, and a bottom of the cylindrical heating plate is embedded in the bottom fixing plate, the cylindrical heating plate and the bottom fixing plate together define the heating chamber, the opening is defined on the top fixing ring, and the at least two snap slots are defined on the top fixing ring.

* * * * *